US006814166B1

(12) United States Patent
LaFreniere et al.

(10) Patent No.: US 6,814,166 B1
(45) Date of Patent: Nov. 9, 2004

(54) DIRECT PUSH DRILLING SWIVEL AND METHOD FOR ITS USE

(75) Inventors: Lorraine M. LaFreniere, Joliet, IL (US); David H. Surgnier, Blanchard, OK (US)

(73) Assignee: The University of Chicago, Chicago, IL (US)

( * ) Notice: Subject to any disclaimer, the term of this patent is extended or adjusted under 35 U.S.C. 154(b) by 0 days.

(21) Appl. No.: 10/235,532

(22) Filed: Sep. 6, 2002

Related U.S. Application Data

(60) Provisional application No. 60/317,442, filed on Sep. 7, 2001.

(51) Int. Cl.[7] ..... E21B 3/02

(52) U.S. Cl. ..... 175/57; 175/162; 175/189

(58) Field of Search ..... 175/20, 57, 162, 175/170, 189, 195

(56) References Cited

U.S. PATENT DOCUMENTS 4,074,775 A * 2/1978 Lee ..... 173/79
4,574,893 A * 3/1986 Young et al. ..... 175/170
4,790,391 A * 12/1988 Hamamura et al. ..... 173/57
4,890,681 A * 1/1990 Skelly ..... 173/163

* cited by examiner

*Primary Examiner*—William Neuder
(74) *Attorney, Agent, or Firm*—McDermott Will & Emery LLP

(57) ABSTRACT

A power swivel provides the rotational force to drill consolidated subsurface strata while an unrestricted airflow through the swivel and down a drill string remove cuttings from the borehole. The power swivel is configured to mount on direct push/driven-vibrating equipment, such as a cone penetrometer, to eliminate the need for a conventional drilling rig when a consolidated layer is encountered during direct push/driven-vibrating operations. A drilling nipple and pack-off are provided near the surface to maintain the air flow during drilling and to direct the cuttings to a desired location. Also, a dual-valved air delivery system provides safe, remote-controlled air flow to the swivel.

31 Claims, 7 Drawing Sheets

DIRECT PUSH DRILLING SWIVEL AND METHOD FOR ITS USE

RELATED APPLICATIONS

This application relates to and claims priority from U.S. Application Ser. No. 60/317,442 filed Sep. 7, 2001 entitled POWER SWIVEL, AIR DELIVERY SYSTEM AND ROTATING HEAD, the disclosure of which is hereby incorporated in its entirety by reference.

FIELD OF THE INVENTION

The present invention relates to machinery and methods for exploring beneath the earth's surface and, more particularly, to stratigraphic exploration.

BACKGROUND OF THE INVENTION

One conventional technology useful for exploring the subsurface characteristics at a geological location includes the use of a cone penetrometer. This apparatus has a cone with an electronic stress sensor that is forced downward through the various subsurface layers. As the cone penetrates different strata, the data sensed by the cone is either collected in the cone or transmitted back to the surface. This data indicates characteristics and thickness of the different strata below the surface.

Recently, other technologies that fall into the general class known as "direct push" equipment have been developed to provide other data about subsurface conditions. One common technology of this nature is known as GeoProbe® and another is HydroPunch.

In practice, these direct push technologies, including the cone penetrometer, are delivered to a field site on some type of mobile platform such as a truck or track-mounted vehicle. The platform is relatively large and heavy in order to handle the forces applied, and support the equipment, involved in direct push techniques. A sensor, such as a cone, is attached to a section of pipe which is, itself, coupled using any of a variety of known means to a mounting system. Included in any of these different platforms are hydraulic rams that attach to this mounting system and produce the downward force needed to push a sensor (and attached piping) down through the ground.

The rams force the mounting system downward which forces the piping and sensor downward as well. As more piping is needed, the mounting system is detached from the top piping section, a new pipe segment is added, and pushing continues. For example, in cone penetrometry, each pipe segment is typically one meter long.

Even though direct push systems can generate up to 40,000 lbs of force, these systems are unable to penetrate or push sensors through consolidated or cemented layers below the surface. In the past, when a consolidated layer was reached, either the site data collection stopped or a conventional drilling rig was brought in to penetrate the consolidated layer.

However, the logistical difficulty in utilizing a conventional drilling rig makes this solution very problematic. An available rig has to first be found and then be delivered to the site. In preparation for the arrival of the drilling rig, the direct push equipment must be cleared from the site and the site prepared for the rig. Water collection ponds and other infrastructure is needed for the conventional drilling rig. Once the drilling operation is completed, the site must be cleaned-up and restored for the return of the direct push equipment.

Accordingly, there is an unmet need for methods and machinery useful with direct push equipment that allows drilling through consolidated surfaces that can be accomplished quickly, efficiently, economically and with as little disruption as possible at a field site.

SUMMARY OF THE INVENTION

The present invention addresses these and other needs by providing an air drilling swivel that works with any direct push equipment so as to provide drilling capabilities in the field without the presence of a conventional drilling rig. As a result, the use of direct push equipment is not significantly hampered when consolidated or cemented layers are encountered during subsurface exploration. Within the present application, the term "direct push" is used for convenience and is intended to encompass both conventional direct push equipment as well as driven, hammer driven, or driven-vibrating equipment.

One aspect of the present invention relates to a method for drilling. According to this aspect direct push equipment is used to push a first set of pipe sections and sensor down a bore hole. Then, the first set of pipe sections and sensor are removed from the bore hole and the direct push equipment. Next a power swivel is attached to the direct push equipment, along with a second set of pipe sections and drill bit; and then drilling is performed further down the bore hole with the power swivel.

Another aspect of the present invention relates to a power swivel for drilling down a bore hole. According to this aspect, the power swivel includes a stationary housing configured to be mounted to direct push equipment; a hollow rotating drive shaft configured to rotate within the stationary housing; and a set of hollow pipe sections. A far end of the pipe sections has a drill bit and a near end of the pipe sections is coupled with the rotating drive shaft such that the hollow region of each pipe section aligns with the hollow region of the rotating drive shaft. Within this arrangement, the stationary housing includes one or more air inlet apertures, and the rotating drive shaft includes one or more air openings and arranged within the housing. These different air openings are arranged so that, while the drive shaft is rotating, the one or more air openings periodically align with the one or more air inlet passages to provide a passage way for air into the hollow drive shaft.

Still other objects and advantages of the present invention will become readily apparent from the following detailed description, simply by way of illustration of the best mode contemplated of carrying out the invention. As will be realized, the invention is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF THE DRAWINGS

The present invention is illustrated by way of example, and not by way of limitation, in the figures of the accompanying drawings and in which like reference numerals refer to similar elements and in which.

DESCRIPTION OF THE PREFERRED EMBODIMENT

To aid with the explanation of the present invention, concrete examples have been given of borehole size, drill rod size, equipment names and drilling environments. The present invention is not limited to these and other specific cases provided herein which, instead, are give only by way of example to aid in the understanding of the present invention.

Figure 1A:
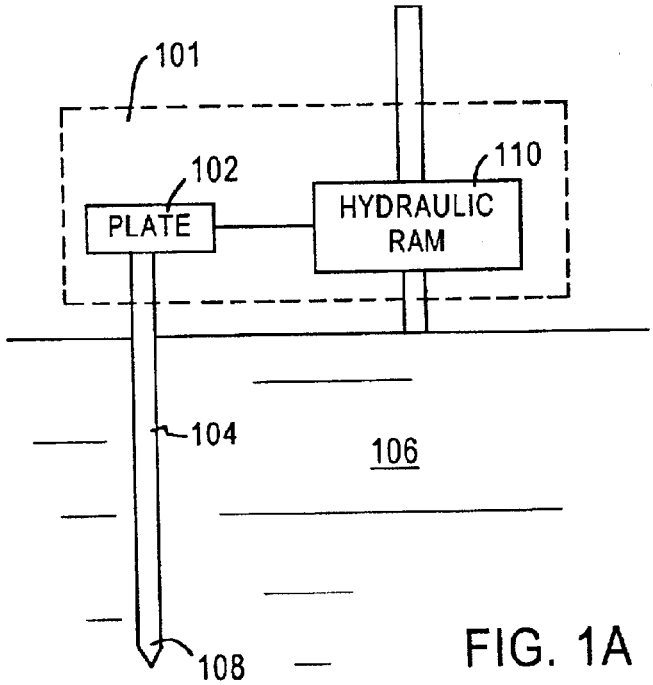
FIG. 1A illustrates an exemplary direct push operation.

FIG. 1A depicts a schematic view of direct push equipment being used in the field. The specific details of the equipment platform 101 (e.g., truck, track-mounted vehicle, etc.) are not shown as the platform involves conventional direct push equipment and which is known in the art.

Within the equipment platform 101, there is a mounting plate 102 that is coupled with one or more pipe sections 104. These multiple pipe sections 104 descend below the surface of the ground 106 and end with a tip section 108 that includes a sensor or other electronic/sampling equipment. The hydraulic ram or rams 110 is coupled with the mounting plate 102 to provide the downward force needed to push the tip or sampling device 108 through the ground 106.

Although depicted as a simple block diagram in FIG. 1A, the hydraulic ram 110 is typically plural hydraulic rams that are evenly located around the mounting plate so as to provide sufficient and evenly distributed downward pressure. The hydraulic ram 110 also provides the upward force needed to raise the plate 102 in order to add new pipe sections 104 and to raise the pipe sections 104 when the tip 108 needs to be removed from the ground.

The arrangement of FIG. 1A will result in the tip sampling equipment 108 being pushed through the ground 106 until a layer is reached that is consolidated, or cemented, and proves too hard to penetrate with direct push technology.

Figure 1B:
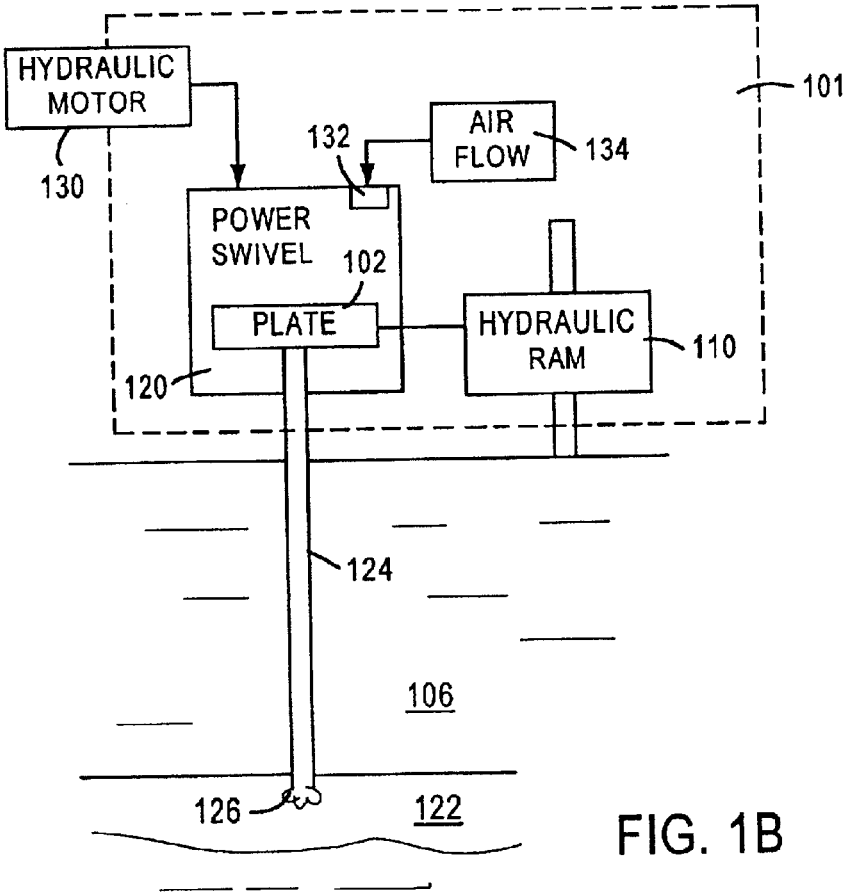
FIG. 1B illustrates an exemplary drilling operation according to an embodiment of the present invention.

FIG. 1B depicts a schematic view of the power swivel 120 attached to the mounting plate 102 and hydraulic rams in accordance with embodiments of the present invention. The power swivel 120 is attached in this manner so that a consolidated layer 122 can be drilled through. Within the field of drilling, in general, a swivel is a mechanical device that simultaneously suspends the weight of a drill string and provides for the rotation of the drill string beneath it. A swivel includes a stationary part, that is coupled with a power source (e.g., a hydraulic motor) and a mounting platform, and a rotating part that is coupled with a drill string. Conventionally, a swivel also permits a high-volume flow of drilling mud or air from the stationary part through to the rotating part without leaking.

The specific type of hydraulic motor is not critical to the present invention; however, one exemplary motor having sufficient capacity to be effective is the DANFOSS OMS 80 151F500 3.

Instead of the sensor tip 108 used in the direct push configuration of FIG. 1A, the drilling arrangement of FIG. 1B includes a drill bit 126 fixedly attached at the end of the drill string comprised of multiple drill pipe sections 124. A hydraulic source provides input to a hydraulic motor 130 that powers the swivel 120. As the hydraulic motor 130 causes a drive shaft of the power swivel 120 to rotate, the drill string 124 rotates causing the drill bit 126 to rotate and cut through the consolidated layer 122. Typical size bore holes would range from 1.25 inches in diameter to 6.25 inches in diameter; although larger scale equipment could be used to produce larger holes.

In the arrangement of FIG. 1B, the power swivel 120 is rigidly and securely attached to the mounting plate 102 and hydraulic rams. Similarly, sections of drill pipe 124 are connected to the power swivel 120. In this manner, the hydraulic ram's action to force the plate 102 downwards (or upwards) is transferred through the power swivel to the drill pipe sections 124. As a result, the drill bit 126 rotates and is pushed through the layer 122 to effect drilling of that layer. By utilizing the direct push platform, that includes hydraulic rams, hydraulic fluid, mounting plates, etc., drilling through consolidated layers is performed without the need to bring in a conventional drilling rig with all the accompanying difficulty.

As shown in FIG. 1B, the power swivel 120 also includes an air inlet 132 that receives an air flow from a source 134. The details and utilization of this air inlet 132 is depicted more clearly in FIG. 2.

Figure 2:
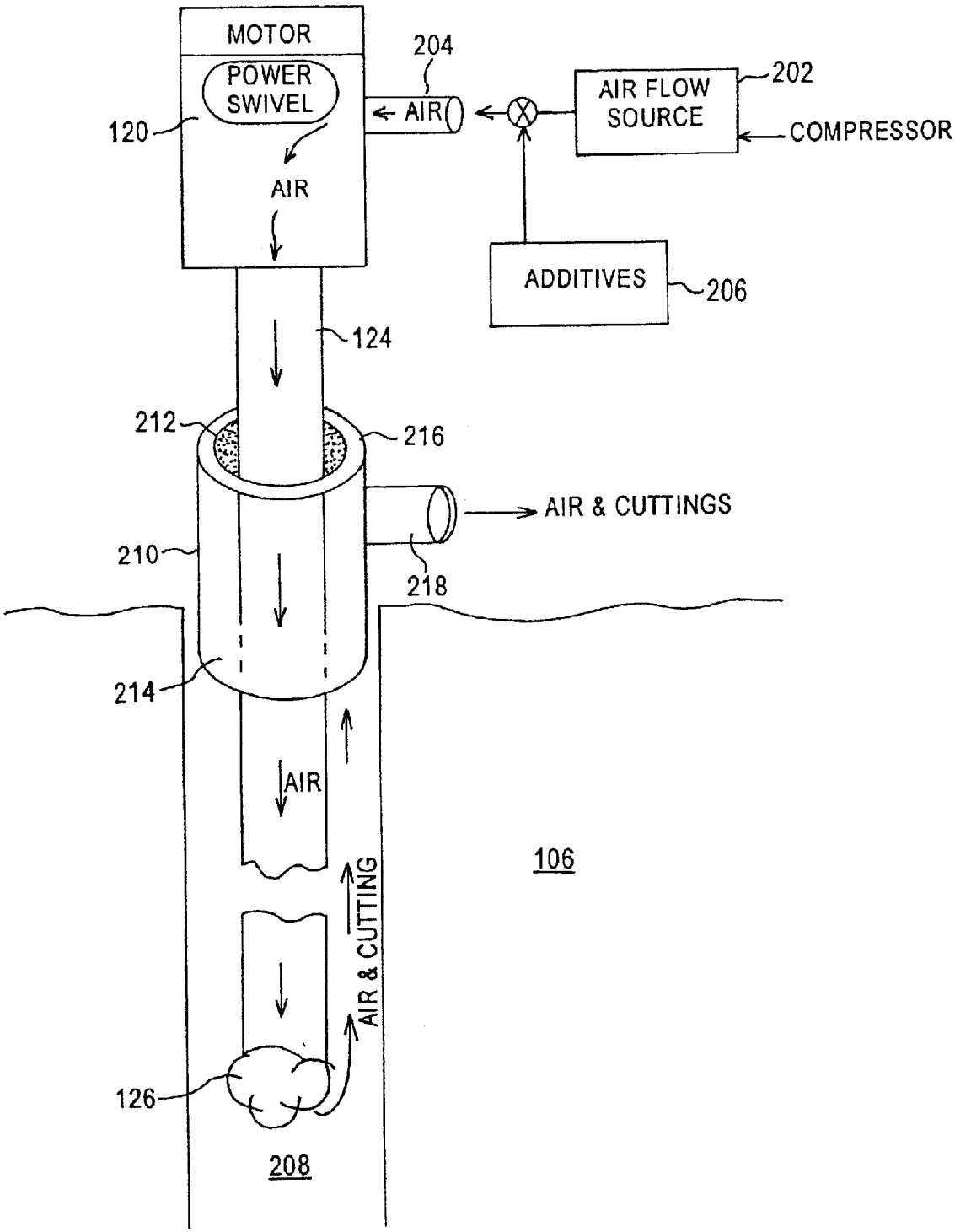
FIG. 2 illustrates a more detailed view of the operation of FIG. 1B.

FIG. 2 shows a more detailed view of the power swivel 120 but, so as not to obscure these details, omits some of the equipment depicted in FIGS. 1A and 1B. In particular, there is a circuitous flow path (illustrated by the arrows) in the drilling arrangement of FIG. 1B that allows air, or other fluids, to be introduced at the power swivel 120, flow through the power swivel 120, enter the pipe string 124, flow through the pipe string 124, exit through the drill bit 126, enter the bore hole, and then exit above ground thereby removing drill cuttings from the borehole.

An air source 202 is connected to the power swivel 120, typically through some type of nipple 204, to produce sufficient air flow to permit drilling. An exemplary air source could be the SULAIR 185H Air Compressor. Additives (e.g., water, surfactants, foam, etc.) 206 can be added to the air flow into the power swivel 120. The proper use of additives according to different drilling conditions encountered in the field is known to a skilled artisan and can be used to improve drilling efficiencies and rates.

The air flow enters the power swivel 120 and is directed downwards toward the pipe string 124. The pipe sections of the pipe string are hollow and permit the air flow to proceed towards the drill bit 126. The drill bit 126 has exit holes, similar in size to the inside diameter of the pipes in the pipe string 124. The air exiting the drill bit 126 enters the borehole 208 and lifts the cutting towards the surface. For example, the drill bit 126 can be approximately 2.5 inches in diameter while the pipes have an outside diameter of nearly two inches. This difference in sizes creates an annular region that permits the air to flow upwards unrestricted but that is not so large as to result in a large loss of velocity. Upon nearing the surface, the air flow is redirected by an air nipple 210.

The air nipple 210 includes a portion 214 that is ideally the diameter of the borehole 208, or at times even larger, and is inserted into the top of the borehole 208 to a depth of approximately 2 to 3 feet or more, for example. The air nipple includes a flange 216 and an annular elastomeric packoff 212. The annular packoff 212 forms a seal around the drill pipe 124 that is inserted through the opening of the air nipple 210. The air nipple 210 also includes an exit aperture 218, known as a blewie line, that allows air flow and cuttings to exit the borehole 208 and acts to direct the exit flow in a desired direction. The air nipple 210 is located at a depth such that the exit aperture 218 is approximately 6 to 18 inches from the surface of the ground 106. A collection apparatus (not shown) can be connected with the aperture 218 to collect cuttings for further analysis and to filter the exiting air flow to prevent detrimental air quality near the drilling site.

In operation, the air flow in the borehole 208 rises until it reaches the air nipple 210. The air flow then enters the annular region formed between the section 214 and the drill pipes 124. The air flow then exits out the exit aperture 218.

Figure 3:
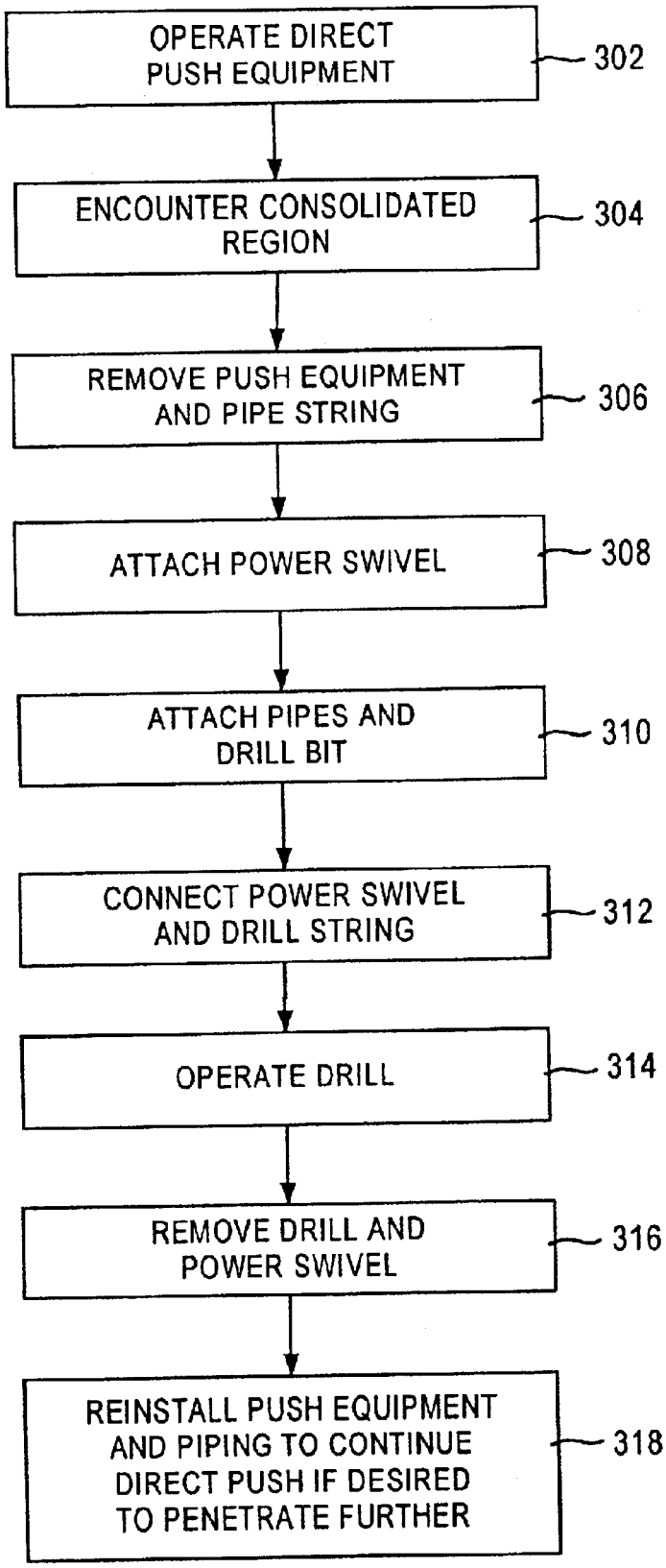
FIG. 3 illustrates a flowchart of using embodiments of the present invention to drill with direct push equipment.

FIG. 3 depicts a flowchart of an exemplary method of utilizing the power swivel 120. According to the flowchart, subsurface exploration begins, in step 302, with operating the direct push equipment in a normal fashion. This operation continues until step 304 when a consolidated or cemented layer is encountered. At this point direct push operations cannot continue.

Accordingly, the pipes that have been attached to the direct push sensors or sampling device are removed, in step 306, one-by-one from the hole in preparation for drilling. Once the direct push sensors or sampling devices and pipes are removed, the power swivel can be attached, in step 308, to the mounting plates and hydraulic rams of the direct push platform. As the power swivel weighs about 100 lbs, it can be maneuvered into place by personnel at the drill site either manually or with mechanical assistance. Attachment of the power swivel also includes connecting the power swivel (and hydraulic motor) to a hydraulic source and an air source.

Next, in step 310, the drill bit and sufficient piping to reach the bottom of the borehole are coupled together and lowered into the borehole. However, before this step is started, an air nipple and pack-off are inserted into the borehole so that the air flow properly exits from the borehole during drilling.

In step 312, the drill string and the power swivel are connected together so that the drilling operation, in step 314, can take place. The drilling operation continues until the consolidated layer is penetrated.

After drilling is completed, the drill bit, piping and power swivel are removed from the direct push platform in step 316. Afterwards, the direct push sensor, drill pipes and equipment are re-installed, in step 318, so that the direct push operation can continue if desired.

Preferably, the same piping can be used in either direct push operation or in drilling operation. One requirement being that the drilling piping needs to have a hollow core to allow air flow of a sufficient volume to permit removal of the cuttings from the bottom of the borehole.

In an alternative scenario, all the strata of interest may be below a known consolidated layer. In this scenario, it is not necessary to start with a direct push operation until reaching that consolidated layer. Instead, drilling can commence from the surface, using the power swivel, and only after the desired stratum has been reached will the direct push equipment be lowered into the borehole.

Figure 4:
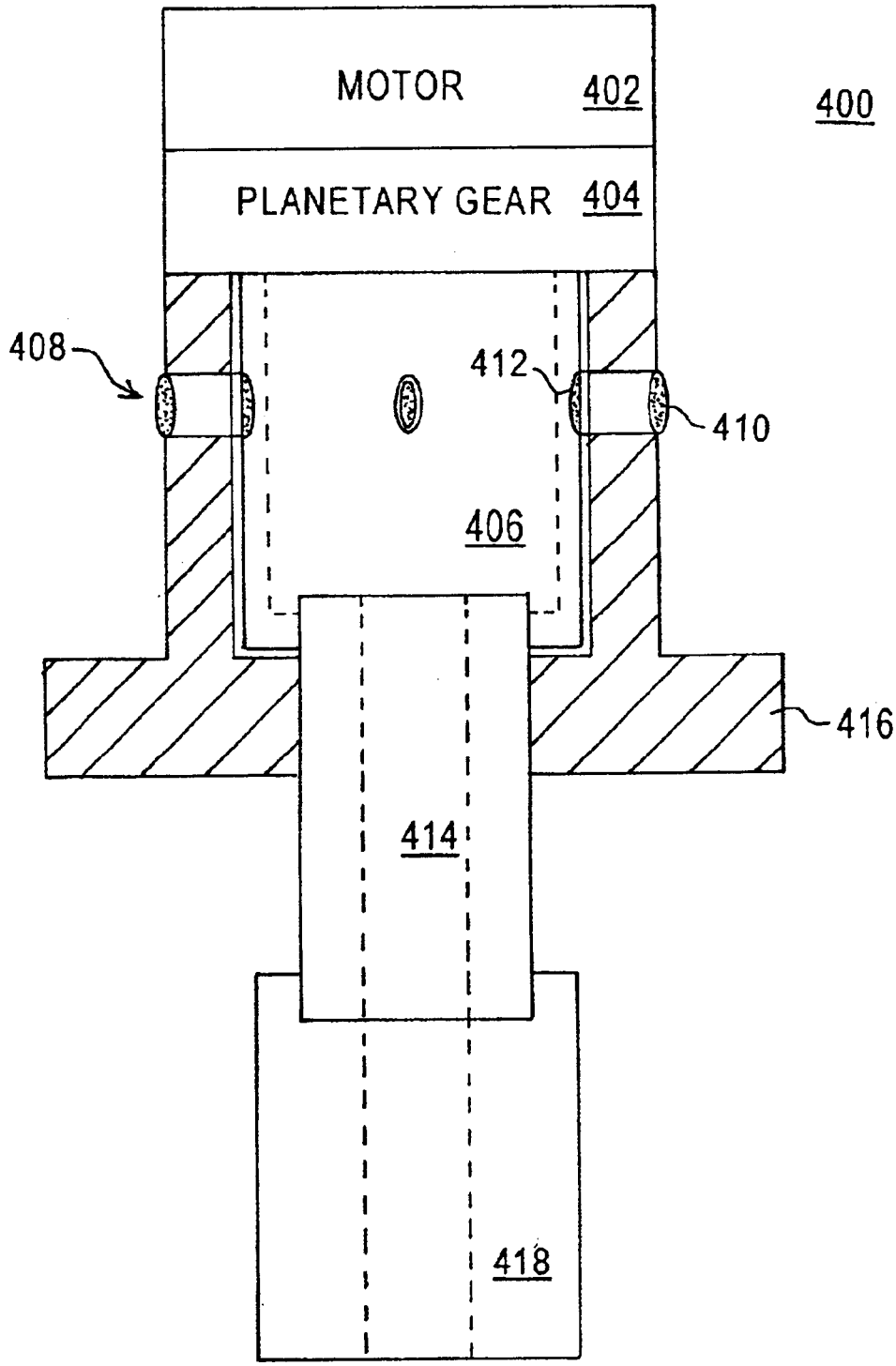
FIG. 4 illustrates a schematic view of an exemplary swivel according to embodiments of the present invention.

A high-level illustration of the power swivel according to one embodiment is depicted in FIG. 4. According to this embodiment, the power swivel includes a number of features that improve its reliability, ease of use and maintenance. Furthermore, one of the critical elements when air drilling is maintaining a sufficient air flow through the flow path. The power swivel of FIG. 4 is designed so that air flow is not restricted into the drill string which results in a large volume of air flowing through the drilling system without the build-up of high pressures. In practice, the present power swivel design enjoys internal pressures typically less than 125 psi.

The hydraulic motor 402 is not specifically a part of the power swivel but is depicted in FIG. 4 to show its relation to the other parts. The swivel 400 includes a number of major sub-assemblies as shown in FIG. 4. Near the motor 402, is the planetary gear assembly 404, this gear assembly reduces the RPMs of the motor 402 to spin the drive shaft 406. Typically, the drive shaft rotates between 0 and 60 RPMs. The drive shaft 406 engages a splined shaft 414 so that when the shaft 406 rotates so does the splined shaft 414. The other end of the splined shaft 414 is operatively coupled with a connecting piece 418 to which a drill string (not shown) is connected. The spinning spline shaft 414 causes the connecting piece 418 to spin which, in turn, rotates a drill bit at the end of a drill string (not shown).

Part of the planetary gear 404, the drive shaft 406 and a portion of the spline shaft 414 are surrounded by a housing 408. During drilling operations, these assemblies rotate within the housing 408 while the housing 408 remains stationary. Although not drawn to scale in FIG. 4, the housing 408 includes mounting flanges 416 which are attached to the direct push platform. Through these flanges 416, the hydraulic rams of the direct push platform are able to exert downward pressure on the housing 408 and a drill string connected thereto. The drill string is forced downwards in the borehole, typically at a range of 0 to 5,000 lbs, while the drill string is rotating. The hydraulic rams also exert an upward force when the drill string needs to be raised.

The external splines on the splined shaft 414 mate with internal splines on the drive shaft 406 in such a way as to permit the spline shaft 414 to move upwards within the opening of the drive shaft 406 to facilitate adding or removing pipe sections to the connecting piece 418. Also, an O-ring or other means (not shown) is included near the top of the spline shaft 414 so that a tight seal is maintained with the drive shaft 406.

The airflow through the power swivel is unrestricted because of the alignment and size of holes 410 and 412 as well as the hollow nature of the rotating components. Holes 410 in the housing 408 are used (typically with a nipple) to introduce air from an external air source into the swivel 400. The holes 412 in the drive shaft 406 allow the air to enter the inside of the rotating portion of the swivel 400. As the drive shaft 406 rotates, one of the holes 412 regularly aligns with the housing hole 410 to create an unrestricted path for air to flow. Conventional drill pipes have an internal diameter of approximately one square inch, although larger (or smaller) sizes are also useful. Thus, the airflow through the holes 410 and 412 of the power swivel 400 should also provide for a full square inch of air to match the inner diameter of the pipe string. By providing this unrestricted airflow, the swivel 400 will allow faster drilling as the large air volume will be able to quickly complete its circuit and remove any cuttings from the borehole.

The embodiment of FIG. 4 depicts four holes 412 spaced at 90 degrees around the drive shaft 406 and two holes 410 opposite each other on the housing 408. Preferably, the holes 412 are roughly one inch square while the holes 410 are slightly larger at approximately 1.3 to 1.4 square inches. Other sizes, numbers, and placements of these holes are also contemplated which provide the equivalent unrestricted air flow throughout the swivel 400.

Both holes 410 do not need to be used simultaneously; doing so only increases the volume of air available for drilling. If one hole 410 is not being used, then it can be plugged.

Figure 5A:
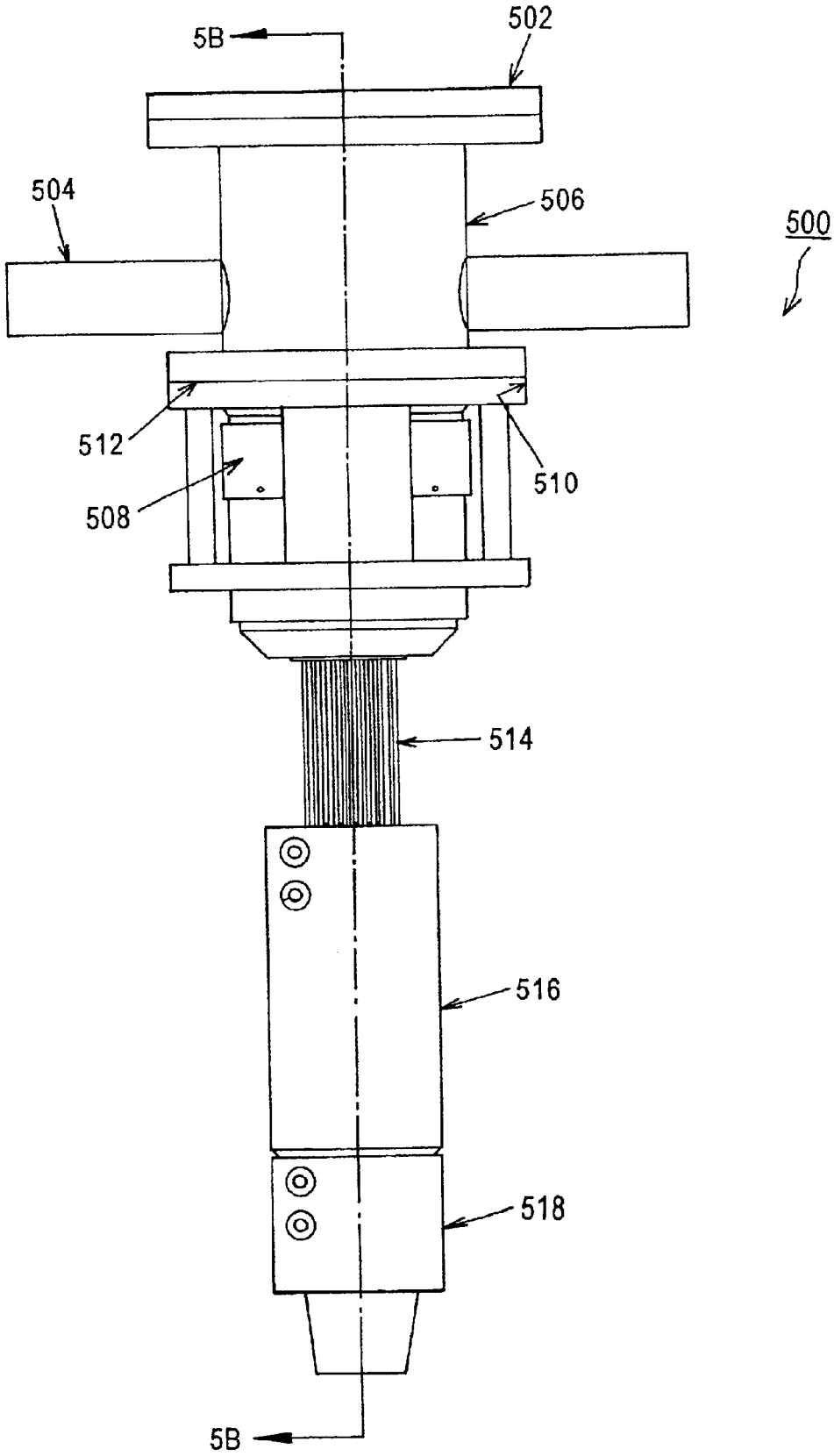
FIGS. 5A and 5B illustrate a detailed view of the swivel of FIG. 4.
Figure 5B:
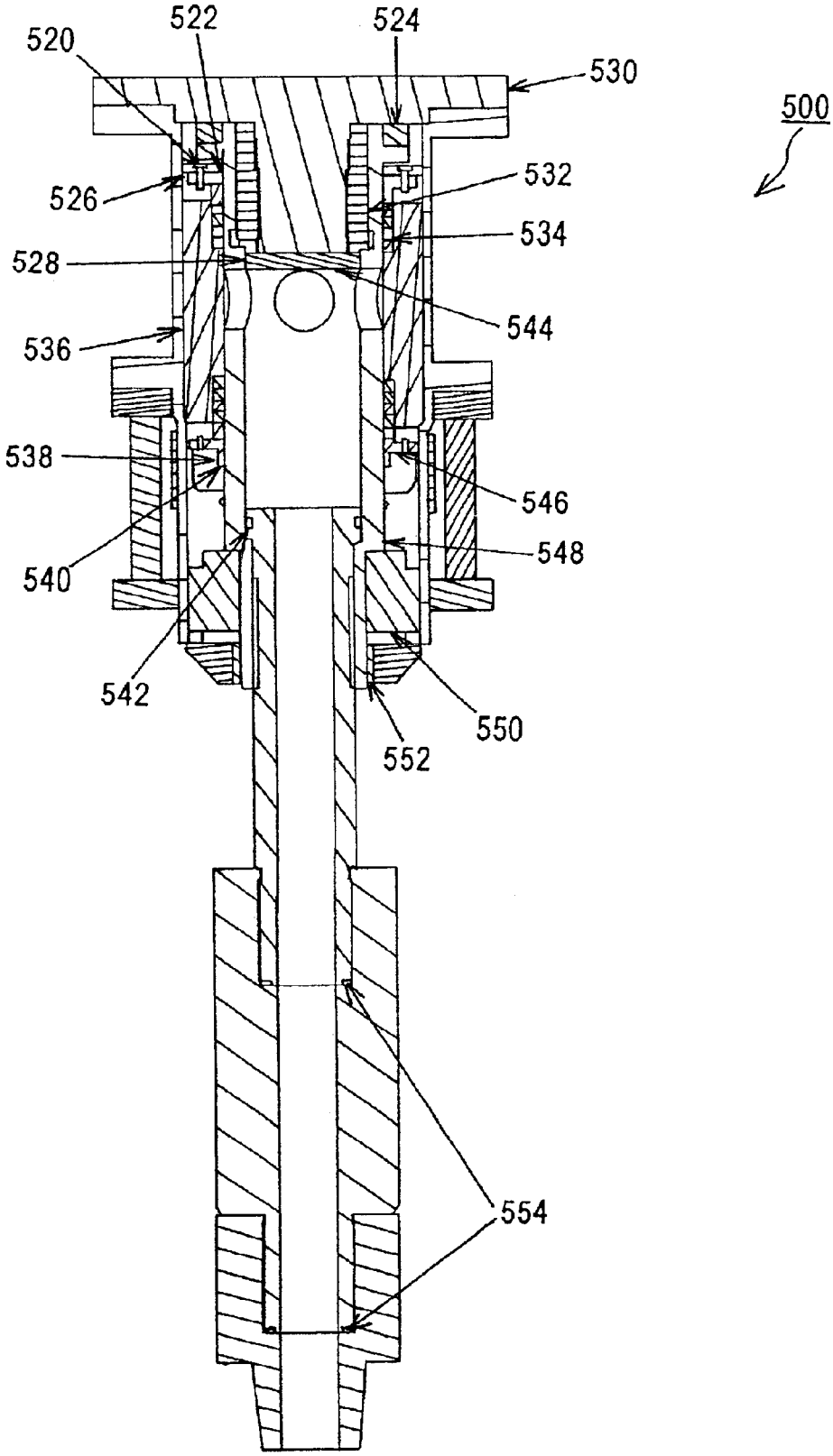

FIGS. 5A and 5B illustrate a side view and a cutaway view, respectively, of a particular embodiment of a power swivel. There are elements of the power swivel 500 that are conventional items such a O-rings, bearings, bolts, etc. that are used in a conventional manner and, although shown in the figures, are not discussed in great detail.

Starting at the top of the swivel 500 shown in FIG. 5A, there is a flange 502 which is useful for attaching the planetary gears, the hydraulic motor and the swivel 500 together. The flange 502 is merely the bottom portion of the planetary gear while the remaining portion of the gear above the flange is not shown in this figure. An air inlet nipple 504 is shown on both sides of the housing 506 which is also known as a case weldment assembly. This housing 506 remains stationary during operation of the swivel 500 while other sub-assemblies housed inside rotate.

Below a middle flange of the housing 506, is a retractable cover 508 that permits access within the housing 506 without requiring disassembly. In reference to FIG. 5B, flexible packing 534 is depicted near the top of the swivel 500. This packing can be, for example, Thermabraid™ packing which is flexible graphite, and will eventually wear down over the lifetime of the swivel 500. Adjustment screws are accessible though the opening behind the cover 508 that enable tightening of the surfaces around the flexible packing 534. By tightening the pressure on the packing 534, its useful lifetime can be extended as compared to packing which needs replacing when it beings showing signs of wear.

Returning to FIG. 5A, attached to the housing 506, using bolts 512, is a flange mounting assembly 510. This assembly 510 is the part of the swivel 500 which is mounted on the direct push equipment during drilling.

The spline shaft 514 exits from the bottom of the housing 506 and couples with a transition, or extension, piece 516 connected to the end piece 518. The tip of the end piece 518 is threaded to mate with conventional drilling piping.

The top of FIG. 5B is similar to that of FIG. 5A in that a portion 530 of the planetary gear is depicted. Within FIG. 5B, there are also a number of O-rings (e.g., 528, 542, and 554) that provide for fluid tight seals between adjacent surfaces. These seals help ensure that the air flow through the power swivel 500 is not diminished by leaks.

Similarly, there are screws (e.g., 520) and bolts (e.g. 522) that are used in their conventional manner to fixedly attach two adjoining surfaces such as the lock plate 526 to its mating surface. There are also a number of elements that are arranged in the annular region between the stationary swivel housing 506 and the rotating drive shaft 548; these elements support the smooth operation of the power swivel but other, functionally equivalent substitutes are contemplated and considered to be within the scope of the present invention. Some of these support elements include the union cylinder 536, the disc spring 538, a washer 540, the union bearing 546 and the casing bearing 552.

Figure 6:
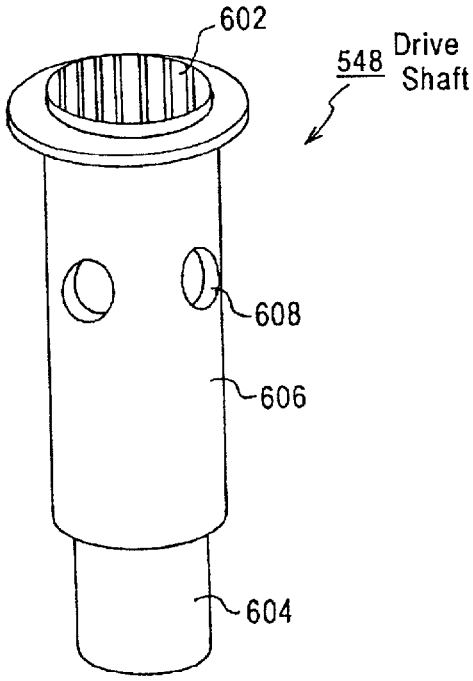
FIG. 6 illustrates a detailed view of an exemplary drive shaft useful in embodiments of the present invention.

The planetary gear 530 has a rotating shaft that is splined on its external face. The drive shaft 548 has a region near its top that has splines on its internal face. While it is possible that these two splines can be arranged so that they mate and engage each other during operation, the preferred embodiment of FIG. 5B includes a spline bushing 532. This bushing 532 has splines on both its internal and external faces. The splines on the inside of the bushing engage the shaft of the planetary gear and the splines on the outside of the bushing 532 engage the inside of the drive shaft 548. FIG. 6 shows a more detailed view of the drive shaft 548. The splines 602 near the top are what mate with the spline bushing 532. The center section 606 is preferably smooth on the inside as this portion does not need to mate with any other surfaces. The bottom section 604 (although not visible from this perspective) includes internal splines that engage the spline shaft 514. A plug 544 fits within the drive shaft 548 below the splined section to prevent air from exiting from the top of the swivel 500.

In operation, the drive shaft 548 rotates at approximately 0 to 60 RPM while the drilling bit is being driven down the borehole. Just as importantly, though, the holes 608 of the drive shaft 548 regularly rotate in front of the air inlets in the housing 506 so that air enters the swivel 500 in an unrestricted manner.

Two important elements of the swivel 500 are thrust bearing 524 and tapered roller bearing 550. The thrust bearings 524 keep the thrust from being transferred in an upward motion to the gear train and prevent downward thrust from being transferred to the housing. As a result, wear and tear on the machinery will be significantly reduced which saves maintenance time and costs. The tapered bearing 550 acts as both a thrust bearing (similar to 524) and as an axial thrust bearing. In other words, this bearing 550 also helps eliminate lateral wear on the packing and housing of the swivel thereby eliminating vibration and lateral movement.

Drilling Nipple and Packoff

Figure 7:
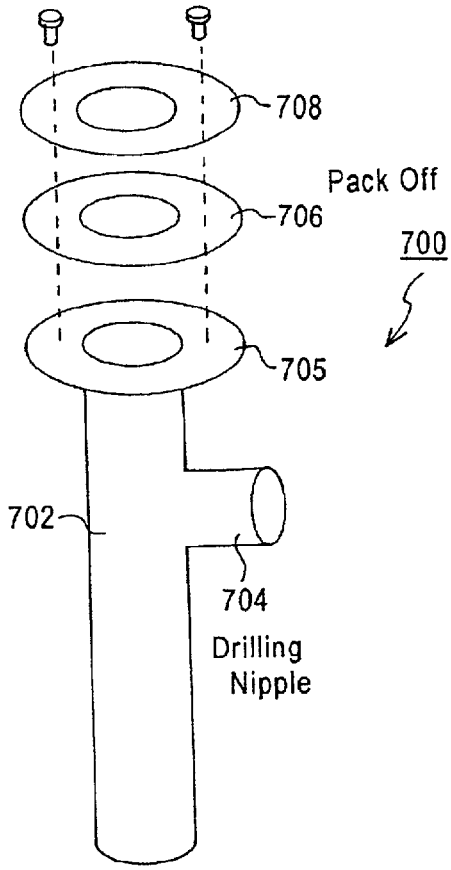
FIG. 7 illustrates an exploded view of a drilling nipple and packoff according to embodiments of the present invention.

FIG. 7 depicts a detailed view 700 of the drilling nipple and packoff whose operation was explained in relation to FIG. 2. In a preferred embodiment, this device 700 is composed of a steel tube 702 approximately 2.5' in length having an internal diameter of approximately 3 inches and an outside diameter of about 3.5 inches. The tube 702 can be constructed from cold rolled steel or other equivalent materials. The lateral opening 704 forms approximately a 90 degree bend with the tube 702 and is around 8 inches from a flange 705. The flange 705 is part of the tube 702 and has a center hole with a 3 inch diameter and a larger outside diameter such as, for example, 6 inches. There are multiple holes through the flange 705 to permit the pipe wiper 706 and top flange 708 to be secured to the flange 705. The pipe wiper 706 can be similar to a one inch pipe wiper manufactured by A. W. Rubber, Inc. that acts as a sealing element between a drilling borehole and push/drill rods or pipes. The top flange 708 also has a three inch inner diameter and a larger outer diameter, such as 8 inches.

Air Delivery System

Figure 8:
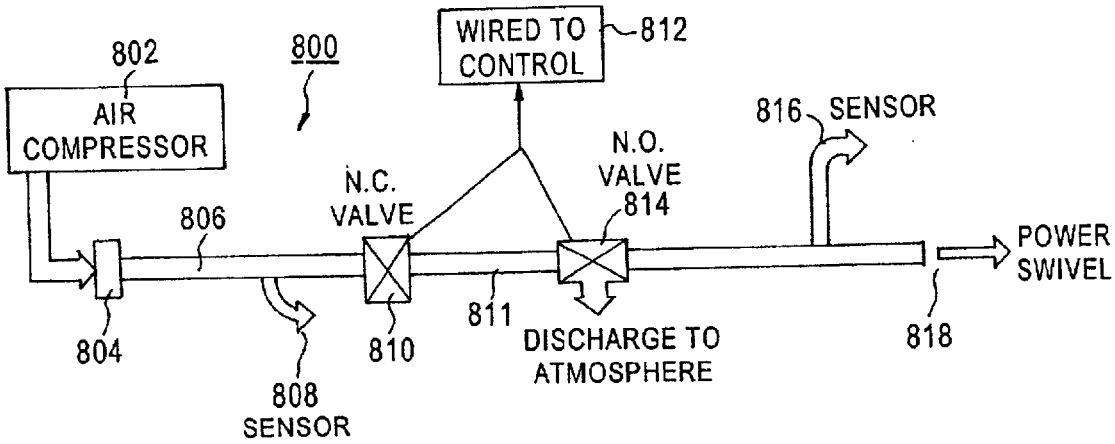
FIG. 8 illustrates an exemplary air delivery system according to embodiments of the present invention.

As mentioned earlier, the power swivel preferably provides air drilling adapted to a variety of push equipment. One embodiment of an air delivery system for the power swivel is depicted in FIG. 8. The air delivered to the power swivel flows through the drilling system in an unrestricted manner such that a full inch of air flow is supported during drilling operations. The embodiment of FIG. 8 is described within the specific environment of providing a full square inch of air flow through the power swivel. If different air volumes are desired, different dimensioned equipment can be readily substituted.

An air compressor 802 is used to provide an external source of air into the air delivery system 800. The compressor 802 is connected to a fitting 804, such as a 1.00" NPT×1.25" Chicago fitting, that is connected to a section of pipe 806, such as 1" extra-heavy steel piping. A Sensor 808 can be included to sense and indicate pressure conditions before the valve 810. Valve 810 is a 1.25" NPT, normally closed, remotely operated valve and is connected by the pipe section 811 with a 1.25" NPT, normally open, valve 814.

The valves 810 and 814 can be solenoid valves or pneumatic valves or even other equivalent valve mechanisms. The valve 810 is used to control and shut off the air supply to the swivel. In the case of a power failure or an emergency, the valve will automatically close to shut off the air supply. In the event of an emergency, valve 814 will open to discharge unrestricted to the atmosphere. This is to release pressure from the piping system. In normal operating mode, the valve 814 can be controlled to release to the atmosphere so as to relieve pressure in order to permit addition or removal of additional rods from the drill string. Both valves 810 and 814 are controllable from a control panel 812 in the drill equipment operator's station.

The precise placement of sensors 808 and 816 on their respective piping segments is not critical as long as sensor 808 is placed before the valve 810 and sensor 816 is placed after the valve 814. These sensors are used to sense pressure within the air delivery system and provide this data to the drill operator.

The end of the air delivery system 818 connects (preferably using some type of quick connect coupling) to a flexible high-pressure delivery line (not shown). The delivery line is connected with the swivel thereby providing air for the drilling operation.

The various embodiments of the swivel described herein have usually been described in the environment of air drilling because air drilling has a number of advantages over fluid drilling. However, the present invention can utilize water, or mud, drilling techniques as well. Similarly, mist drilling, foam drilling and other drilling techniques are contemplated for use with the present invention. The use of air flow, however, eliminates contaminated drilling fluvias being raised to the surface, significantly reduces the potential for contamination of underground aquifers through filtration of free water in the mud system, and enables drilling in freezing weather.

Although the present invention has been described and illustrated in detail, it is understood that the same is by way of illustration and example only, and is not to be taken as a limitation, in scope or spirit, of the present invention which is limited only by the terms of the appended claims.

What is claimed is:

1. A method for drilling, comprising the steps of:

using direct push equipment to push a first set of pipe sections and sensor or sampler down a bore hole;

removing the first set of pipe sections and sensor or sampler from the bore hole and the direct push equipment;

attaching a power swivel to the direct push equipment, along with a second set of pipe sections and drill bit; and drilling further in the bore hole with the power swivel.

2. The method according to claim 1, wherein said drilling step is performed to drill through a consolidated layer.

3. The method according to claim 2, further comprising the steps of:

after drilling through the consolidated layer; removing the power swivel from the direct push equipment along with the second set of pipe sections and drill bit;

attaching the direct push equipment to a third set of pipe sections and the sensor or sampler; and continuing direct push operations in the bore hole with the sensor or sampler.

4. The method according to claim 1, further comprising the step of:

circulating an air flow through the power swivel, second set of pipe sections, and drill bit during the drilling step; said air flow operating to bring drill cuttings near the top of the bore hole.

5. The method according to claim 4, wherein the air flow is unrestricted and has a cross-sectional area of at least one square inch.

6. The method according to claim 4, further comprising the steps of:

providing a pack-off to effect a seal around the second set of pipe sections and the bore hole; and diverting the drill cuttings near the top of the bore hole at substantially a 90 degree angle from a major axis of the bore hole.

7. The method according to claim 1, further comprising the step of:

delivering air to the power swivel using a delivery system comprising one or more remotely operated valves.

8. The method according to claim 7, wherein the step of delivering further includes the steps of:

receiving air at a first valve from an air source, said first valve permitting air flow through the delivery system during drilling and reverting to a normally closed state upon power failure to prevent air flow through the delivery system;

receiving air at the second valve from the first valve, said second valve permitting air flow through the delivery system during drilling and reverting to a normally open state upon power failure to vent air to atmosphere; and delivering air from the second valve to the power swivel.

9. The method according to claim 8, further comprising the step of:

remotely controlling the first valve to close and the second valve to open in order to bleed the delivery system before adding or removing a new pipe section to the second set of pipe sections.

10. The method according to claim 8, wherein the first and second valves are solenoid valves.

11. The method according to claim 8, wherein the first and second valves are pneumatic valves.

12. The method according to claim 8, further comprising the step of:

monitoring the pressure within the delivery system.

13. The method according to claim 1, further comprising the step of:

powering the power swivel with a hydraulic motor that receives hydraulic fluid from the direct push equipment.

14. A power swivel for drilling down a pushed or driven bore hole comprising:

a stationary housing configured to be mounted to direct push equipment;

a hollow rotating drive shaft configured to rotate within said housing;

a set of hollow pipe sections, with a drill bit at a first end and coupled with the rotating drive shaft from a second end such that the hollow region of each pipe section aligns with the hollow region of the rotating drive shaft;

said stationary housing including one or more air inlet apertures; and said rotating drive shaft including one or more air openings and arranged within the housing so that, while the drive shaft is rotating, the one or more air openings periodically align with the one or more air inlet passages to provide a passage way for air into the hollow drive shaft.

15. The power swivel according to claim 14, wherein:

the drill bit includes an air exit hole;

the hollow region of the drive shaft, the drill pipes, the drill bit, and the bore hole form an air flow circuit to remove cuttings from the bore hole while the drill bit is drilling.

16. The power swivel according to claim 15, further comprising:

a pack-off forming a seal around the set of hollow pipe sections and the bore hole; and a drilling nipple below the pack-off that directs air flow and cuttings exiting the bore-hole, wherein said pack-off and drilling nipple are included in said air flow circuit.

17. The power swivel according to claim 14, wherein the passage way for air provides at least a cross-sectional area of one square inch of air flow.

18. The power swivel according to claim 14, further comprising:

adjustable packing located in a cavity between the stationary housing and the rotating drive shaft, wherein said adjustable packing deforms so as not to fill the cavity as it wears from operation.

19. The power swivel according to claim 18, further comprising:

means to adjust the adjustable packing to cause the adjustable packing to fill the cavity; wherein said means are accessible without disassembly of the power swivel.

20. The power swivel according to claim 14, wherein the rotating drive shaft rotates between 0 and 60 revolutions per minute.

21. The power swivel according to claim 14, wherein the direct push equipment forces the drill bit downwards with a force between 0 and 5,000 pounds.

22. The power swivel according to claim 14, further comprising:

a hydraulic motor coupled with a hydraulic source from the direct push equipment.

23. The power swivel according to claim 22, further comprising:

a planetary gear coupled with the hydraulic motor and the rotating drive shaft to transfer power from the motor to the shaft.

24. The power swivel according to claim 23, wherein the hydraulic motor rotates faster than 60 revolutions per minute.

25. The power swivel according to claim 14, further comprising:

a remotely operated air delivery system that supplies air to the one or more air inlet apertures.

26. The power swivel according to claim 25, wherein the air delivery system includes:

a control, available to an operator of the direct push equipment, for controlling the air delivery system;

a pathway having a first end coupled with an air source and a second end coupled with the one or more air inlet apertures;

a first valve located proximate the first end, said first valve permitting air flow in the pathway during drilling and reverting to a normally closed state upon power failure to block air flow in the pathway; and a second valve located between the first valve and the second end, said second valve permitting air flow in the pathway during drilling and reverting to a normally open position upon power failure to open the path way to atmosphere.

27. The power swivel according to claim 26, further comprising:

a first pressure sensor located between the first end and the first valve;

a second pressure sensor located between the second valve and the second end; and a display available to an operator of the direct push equipment indicating the sensed air pressures.

28. The power swivel according to claim 26, wherein the control is configured to close the first valve and open the second valve to relieve pressure in the pathway before addition or removal of a pipe section from the set of hollow pipe sections.

29. The power swivel according to claim 26, wherein the first and second valves are solenoid valves.

30. The power swivel according to claim 26, wherein the first and second valves are pneumatic valves.

31. The power swivel according to claim 14 further comprising:

a spline bushing configured to couple a first end of the rotating drive shaft with a power source;

a hollow spline shaft having a first and second end, said first end configured to couple with a second end of the rotating drive shaft; and a hollow transition section having a first end configured to engage the second end of the spline shaft and a second end configured to engage a top pipe section of the set of hollow pipe sections;

wherein hollow regions of the drive shaft, spline shaft, transition section and pipe sections align to form a passageway for air flow entering the drive shaft.

* * * * *

UNITED STATES PATENT AND TRADEMARK OFFICE

CERTIFICATE OF CORRECTION

PATENT NO. : 6,814,166 B1
DATED : November 9, 2004
INVENTOR(S) : LaFreniere, Lorraine M. et al.

It is certified that error appears in the above-identified patent and that said Letters Patent is hereby corrected as shown below:

Column 1,
Line 4, insert

-- GOVERNMENT SUPPORT

The United States Government has rights in this invention under Contract No. W-31-109-ENG-38 between the U.S. Department of Energy and the University of Chicago representing Argonne National Laboratory --.

Signed and Sealed this

Twenty-sixth Day of April, 2005

JON W. DUDAS
*Director of the United States Patent and Trademark Office*